US006938426B1

(12) United States Patent
Acharya et al.

(10) Patent No.: US 6,938,426 B1
(45) Date of Patent: Sep. 6, 2005

(54) CRYOCOOLER SYSTEM WITH FREQUENCY MODULATING MECHANICAL RESONATOR

(75) Inventors: Arun Acharya, East Amherst, NY (US); Bayram Arman, Grand Island, NY (US); Richard C. Fitzgerald, Grand Island, NY (US); James Joseph Volk, Clarence, NY (US); John Henri Royal, Grand Island, NY (US); Al-Khalique Shariff Hamilton, Grand Island, NY (US)

(73) Assignee: Praxair Technology, Inc., Danbury, CT (US)

( * ) Notice: Subject to any disclaimer, the term of this patent is extended or adjusted under 35 U.S.C. 154(b) by 26 days.

(21) Appl. No.: 10/812,174

(22) Filed: Mar. 30, 2004

(51) Int. Cl.[7] ..... F25B 9/00
(52) U.S. Cl. ..... 62/6
(58) Field of Search ..... 62/6

(56) References Cited

U.S. PATENT DOCUMENTS 5,129,232 A 7/1992 Minas et al. ..... 62/51.1
5,363,077 A 11/1994 Herd et al. ..... 335/216
5,904,046 A * 5/1999 Kawano ..... 62/6
6,374,617 B1 4/2002 Bonaquist et al. ..... 62/6
6,378,312 B1 4/2002 Wang ..... 62/6
6,434,947 B2 * 8/2002 Zhu et al. ..... 62/6
6,578,364 B2 6/2003 Corey ..... 62/6
6,604,363 B2 8/2003 Corey et al. ..... 62/6
6,640,553 B1 11/2003 Kotsubo et al. ..... 62/6
6,644,038 B1 11/2003 Acharya et al. ..... 62/6

FOREIGN PATENT DOCUMENTS

JP 09296965 A * 11/1997 ..... F25B 9/00

OTHER PUBLICATIONS

Matsubara et al., "Pressure Wave Generator for a Pulse Tube Cooler", Cryocoolers 12 (2003) pp 343-349.

* cited by examiner

*Primary Examiner*—Denise L. Esquivel
*Assistant Examiner*—Richard L. Leung
(74) *Attorney, Agent, or Firm*—Stanley Ktorides

(57) ABSTRACT

A refrigeration generation system wherein a frequency modulating mechanical resonator is positioned between a pressure wave generator and a cryocooler and serves to reduce the frequency of the oscillating gas emanating from the pressure wave generator so that it more closely comports with a more efficient operating frequency of the cryocooler.

9 Claims, 3 Drawing Sheets

CRYOCOOLER SYSTEM WITH FREQUENCY MODULATING MECHANICAL RESONATOR

TECHNICAL FIELD

This invention relates generally to low temperature or cryogenic refrigeration such as refrigeration generated by a pulse tube cryocooler.

BACKGROUND ART

A recent significant advancement in the field of generating low temperature refrigeration is the development of cryocoolers such as the pulse tube cryocooler system wherein pulse energy is converted to refrigeration using an oscillating gas. Such systems can generate refrigeration to very low levels sufficient, for example, to liquefy helium. One important application of the refrigeration generated by such cryocooler systems is in magnetic resonance imaging systems. Other such cryocooler systems are Gifford-McMahon cryocoolers and Stirling cryocoolers.

One problem with conventional cryocooler systems is a potential inefficiency due to a mismatch between the most efficient operating frequency of the cryocooler system and the most efficient operating frequency of the oscillating gas generating system.

Accordingly it is an object of this invention to provide an improved cryocooler system which has more efficient operation.

SUMMARY OF THE INVENTION

The above and other objects, which will become apparent to those skilled in the art upon a reading of this disclosure, are attained by the present invention, one aspect of which is:

A method for operating a cryocooler system comprising:

(A) generating an oscillating gas oscillating at a frequency within the range of from 25 to 120 hertz using an electrically driven pressure wave generator;

(B) reducing the frequency of the oscillating gas using a frequency modulating mechanical resonator to produce lower frequency oscillating gas; and (C) passing the lower frequency oscillating gas to a cryocooler for the generation of refrigeration.

Another aspect of the invention is:

A frequency modulated cryocooler system comprising:

(A) an electrically driven pressure wave generator;

(B) a frequency modulating mechanical resonator for receiving oscillating gas from the pressure wave generator; and (C) a cryocooler for receiving oscillating gas from the frequency modulating mechanical resonator.

As used herein the term "regenerator" means a thermal device in the form of porous distributed mass or media, such as spheres, stacked screens, perforated metal sheets and the like, with good thermal capacity to cool incoming warm gas and warm returning cold gas via direct heat transfer with the porous distributed mass.

As used herein the term "thermal buffer tube" means a cryocooler component separate from the regenerator and proximate the cold heat exchanger and spanning a temperature range from the coldest to the warmer heat rejection temperature for that stage.

As used herein the term "indirect heat exchange" means the bringing of fluids into heat exchange relation without any physical contact or intermixing of the fluids with each other.

As used herein the term "direct heat exchange" means the transfer of refrigeration through contact of cooling and heating entities.

As used herein the term "frequency modulating mechanical resonator" means a combination of one or more of a mass member, spring, and piston system that is designed to modulate the operating frequency of a cryocooler to an improved level of performance.

BRIEF DESCRIPTION OF THE DRAWINGS

The numerals in the Drawings are the same for the same or similar elements.

DETAILED DESCRIPTION

The invention comprises the use of a low loss frequency modulating mechanical resonator positioned between an electrically driven pressure wave generator and a cryocooler to drive the low frequency cryocooler without losing any power rating of the electric motor which is operating at the natural AC frequency. A mechanical resonator is an energy transmission device, thus it is expected to have relatively low loss. A low loss mechanical resonator is a device having losses that are much smaller than a comparable fluid resonator, i.e. long pipe.

Figure 1:
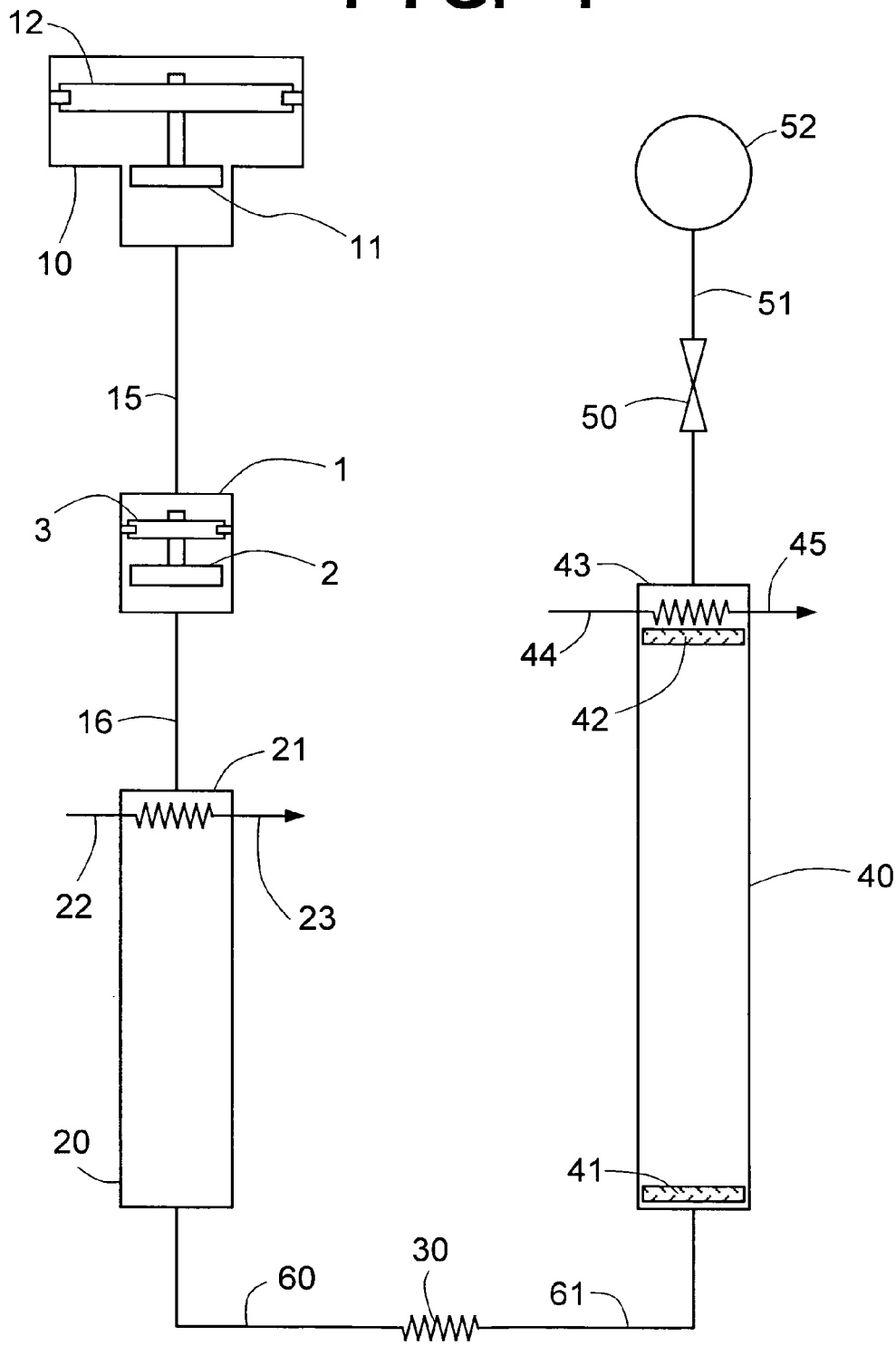
FIG. 1 is a simplified representation of one preferred embodiment of the invention employing an inline frequency modulating mechanical resonator and wherein the cryocooler is a pulse tube cryocooler.

The invention will be described in greater detail with reference to the Drawings. Referring now to FIG. 1 pressure wave generator 10, which is a resonant linear motor compression system, has an axially reciprocating electromagnetic transducer with suspension system 12 with attached piston 11. This reciprocating piston generates oscillating motion at the frequency of the AC power supplied (not shown). Though not shown there is a cooling system to remove heat generated due to frictional and electrical losses in the resonant linear motor. The pressure wave generator will operate at the natural frequency of the AC power and typically produces oscillating gas at a frequency within the range of from 25 to 120 hertz. The optimum operating frequency of the cryocooler could be much different than that of the pressure wave generator. Thus there is a mismatch between where the pressure wave generator and cryocooler operate efficiently. Especially cryocoolers for low temperatures, i.e. less than 70K, operate more efficiently at frequencies lower than 50 hertz. Indeed, the most efficient operating frequency of these cryocoolers may be less than 30 hertz, preferably less than 10 hertz, and the most preferably less than 5 hertz.

The oscillating gas generated by the pressure wave generator passes in line 15 to low loss frequency modulating mechanical resonator 1 which is located between pressure wave generator 10 and the cryocooler. Frequency modulating mechanical resonator 1 has a solid piston or mass 2 and is designed to convert the operating frequency of the pressure wave generator into the operating frequency of cryocooler regenerator 20 and thermal buffer tube 40; in other words, the frequency modulating mechanical resonator replicates the dynamic conditions of the cryocooler at the warm end of its regenerator 20. Suspension member shown as 3 are linear suspension elements that provide stability to solid piston movement. A well-designed frequency modulating mechanical resonator will minimize losses due to friction and drag.

Figure 2:
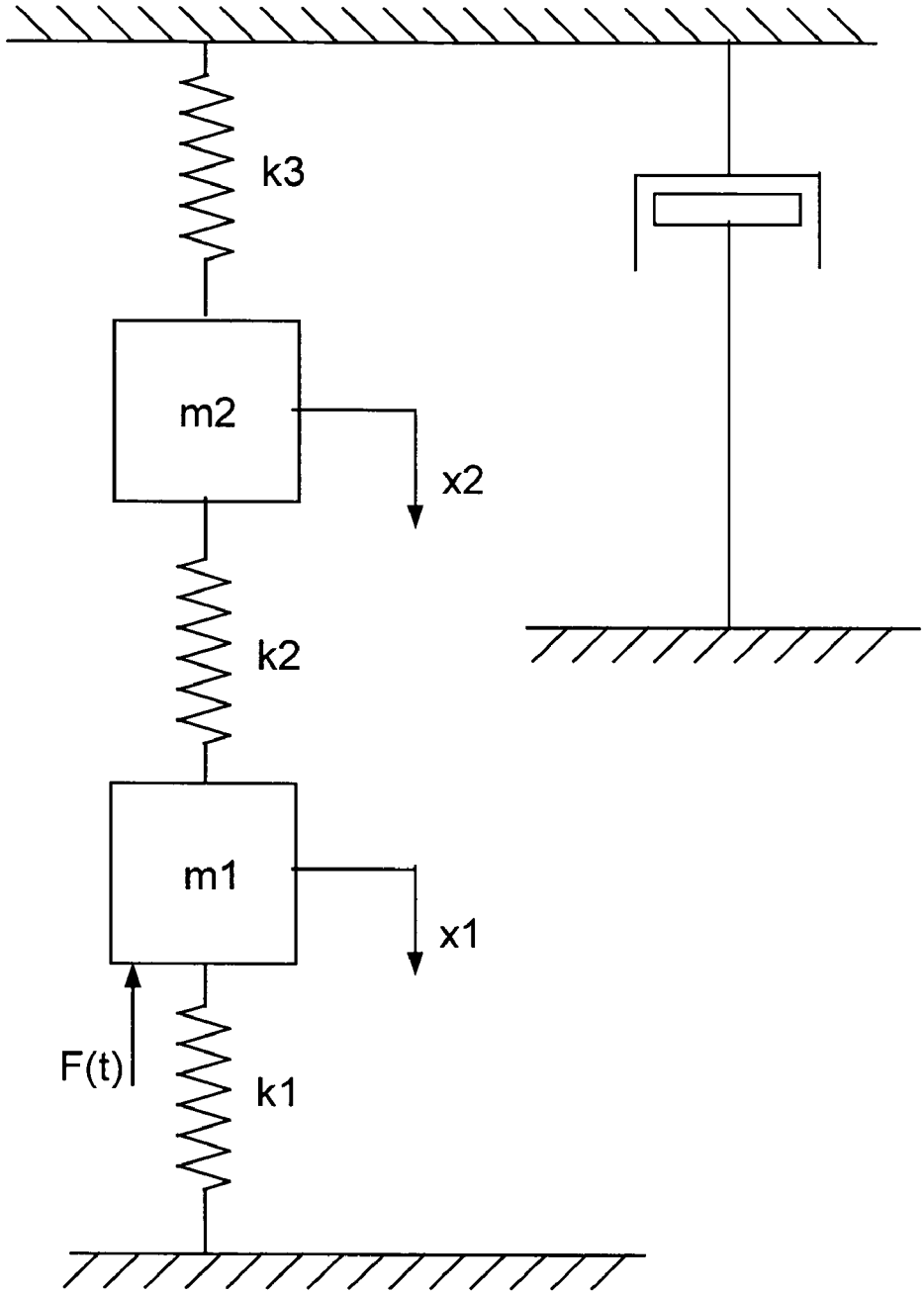
FIG. 2 is a schematic of a frequency modulating system which may be used in the practice of this invention.

FIG. 2 is a schematic spring, mass and dashpot representation of a frequency modulating mechanical resonator which may be used in the system shown in FIG. 1. Referring now to FIG. 2, a first mass $m_1$ is connected to a spring $k_1$ and is free to oscillate in one direction $x_1$. This first mass and spring represents pistons of a typical pressure wave generator 10. Applied to it is a forcing function, F(t) that is sinusoidal with time. This mass-spring is connected to an additional spring ($k_2$)-mass ($m_2$)-spring ($k_3$) system that is free to oscillate where $m_2$ represents frequency modulating mechanical resonator 1. The entire system has two degrees of freedom $x_1$ and $x_2$, which can experience two distinct natural frequencies, $\omega_1$ and $\omega_2$. Effectively, the springs and mass can be designed to produce two separate motions both at a unique frequency.

The frequency modulating mechanical resonator serves to reduce the frequency of the oscillating gas to produce lower frequency oscillating gas which has a frequency which is lower than the resonant frequency of the pressure wave generator and which is closer to the preferable operating frequency of the cryocooler. The lower frequency oscillating gas generally has a frequency less than 40 hertz, typically has a frequency less than 30 hertz, preferably less than 10 hertz, most preferably less than 5 hertz. Referring back now to FIG. 1, the lower frequency pulsing gas is then passed in line 16 to regenerator 20 of the pulse tube cryocooler. Regenerator 20 is in flow communication with thermal buffer tube 40 of the pulse tube cryocooler.

The lower frequency oscillating gas applies a pulse to the hot end of regenerator 20 thereby generating an oscillating working gas and initiating the first part of the pulse tube sequence. The pulse serves to compress the working gas producing hot compressed working gas at the hot end of the regenerator 20. The hot working gas is cooled, preferably by indirect heat exchange with heat transfer fluid 22 in heat exchanger 21, to produce warmed heat transfer fluid in stream 23 and to cool the compressed working gas of the heat of compression. Examples of fluids useful as the heat transfer fluid 22, 23 in the practice of this invention include water, air, ethylene glycol and the like. Heat exchanger 21 is the heat sink for the heat pumped from the refrigeration load against the temperature gradient by the regenerator 20 as a result of the pressure-volume work generated by the pressure wave generator.

Regenerator 20 contains regenerator or heat transfer media. Examples of suitable heat transfer media in the practice of this invention include steel balls, wire mesh, high density honeycomb structures, expanded metals, lead balls, copper and its alloys, complexes of rare earth element(s) and transition metals. The pulsing or oscillating working gas is cooled in regenerator 20 by direct heat exchange with cold regenerator media to produce cold pulse tube working gas.

Thermal buffer tube 40 and regenerator 20 are in flow communication. The flow communication includes cold heat exchanger 30. The cold working gas passes in line 60 to cold heat exchanger 30 and in line 61 from cold heat exchanger 30 to the cold end of thermal buffer tube 40. Within cold heat exchanger 30 the cold working gas is warmed by indirect heat exchange with a refrigeration load thereby providing refrigeration to the refrigeration load. This heat exchange with the refrigeration load is not illustrated. One example of a refrigeration load is for use in a magnetic resonance imaging system. Another example of a refrigeration load is for use in high temperature superconductivity.

The working gas is passed from the regenerator 20 to thermal buffer tube 40 at the cold end. Preferably, as illustrated in FIG. 1 thermal buffer tube 40 has a flow straightener 41 at its cold end and a flow straightener 42 at its hot end. As the working gas passes into thermal buffer tube 40 it compresses gas in the thermal buffer tube and forces some of the gas through heat exchanger 43 and orifice 50 in line 51 into the reservoir 52. Flow stops when pressures in both the thermal buffer tube and the reservoir are equalized.

Cooling fluid 44 is passed to heat exchanger 43 wherein it is warmed or vaporized by indirect heat exchange with the working gas, thus serving as a heat sink to cool the compressed working gas. Resulting warmed or vaporized cooling fluid is withdrawn from heat exchanger 43 in stream 45. Preferably cooling fluid 44 is water, air, ethylene glycol or the like.

In the low pressure point of the pulsing sequence, the working gas within the thermal buffer tube expands and thus cools, and the flow is reversed from the now relatively higher pressure reservoir 52 into the thermal buffer tube 40. The cold working gas is pushed into the cold heat exchanger 30 and back towards the warm end of the regenerator while providing refrigeration at heat exchanger 30 and cooling the regenerator heat transfer media for the next pulsing sequence. Orifice 50 and reservoir 52 are employed to maintain the pressure and flow waves in appropriate phases so that the thermal buffer tube generates net refrigeration during the compression and the expansion cycles in the cold end of thermal buffer tube 40. Other means for maintaining the pressure and flow waves in phase which may be used include inertance tube and orifice, expander, linear alternator, bellows arrangements, and a work recovery line connected back to the compressor with a mass flux suppressor. In the expansion sequence, the working gas expands to produce working gas at the cold end of the thermal buffer tube 40. The expanded gas reverses its direction such that it flows from the thermal buffer tube toward regenerator 20. The relatively higher pressure gas in the reservoir flows through valve 50 to the warm end of the thermal buffer tube 40. In summary, thermal buffer tube 40 rejects the remainder of pressure-volume work generated by the compression system as heat into warm heat exchanger 43.

The expanded working gas emerging from heat exchanger 30 is passed in line 60 to regenerator 20 wherein it directly contacts the heat transfer media within the regenerator to produce the aforesaid cold heat transfer media, thereby completing the second part of the pulse tube refrigeration generation sequence and putting the regenerator into condition for the first part of a subsequent pulse tube refrigeration generation sequence.

Figure 3:
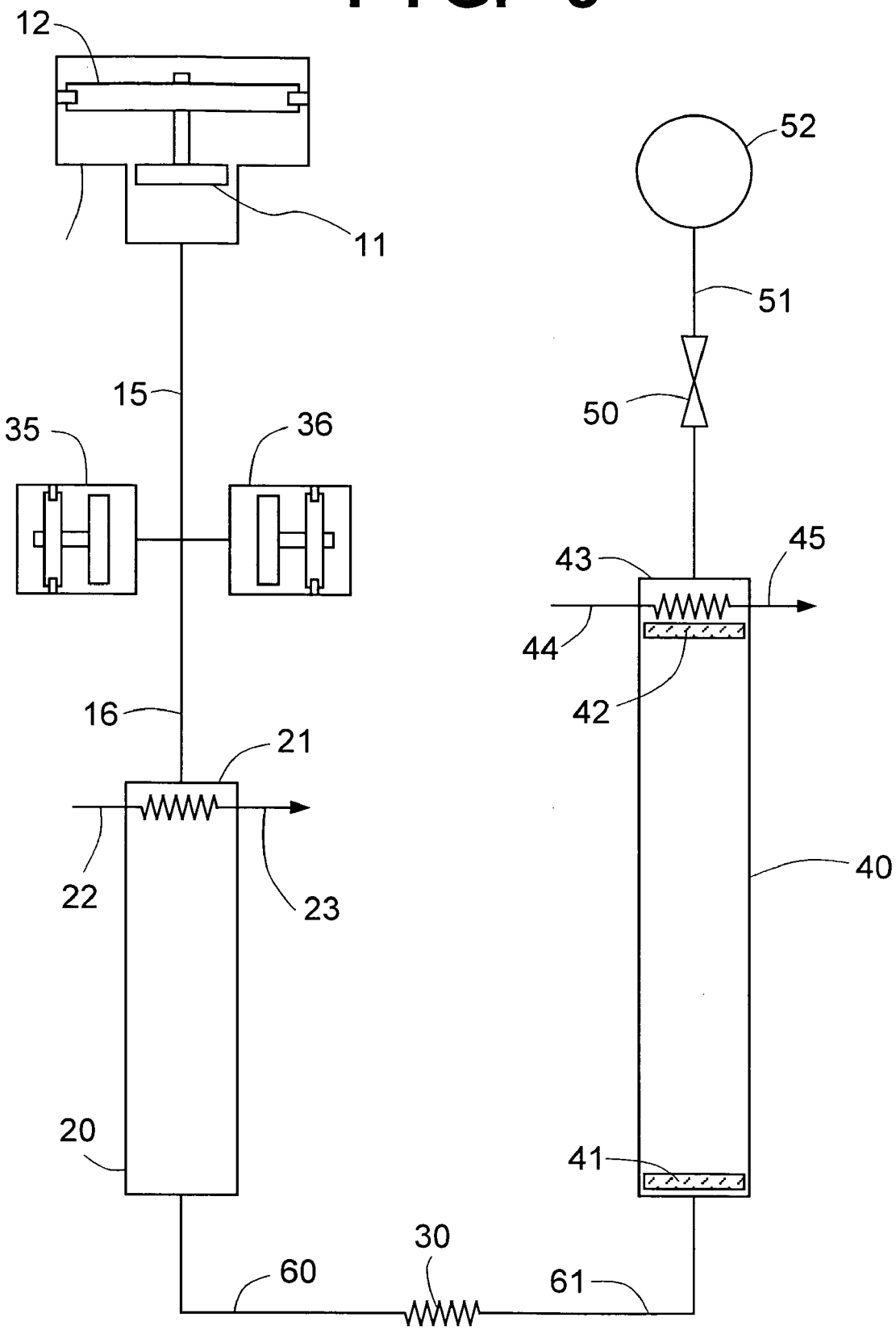
FIG. 3 is a simplified representation of another preferred embodiment of the invention employing vibration balanced frequency modulating mechanical resonators and wherein the cryocooler is a pulse tube cryocooler.

FIG. 3 illustrates another arrangement which is similar to that illustrated in FIG. 1, but which employs two frequency modulating mechanical resonators 35 and 36. This is a vibration balanced system using dual opposing frequency modulating mechanical resonators to eliminate vibration signatures generated by the frequency modulation devices. The elements of FIG. 3 which are common with those of FIG. 1 will not be described again in detail. A single piston in an oscillation condition induces reactive/reflective vibrational noise. Dual opposing pistons in phase, such as with the system shown in FIG. 3, mitigate such reactive/reflective vibrational noise.

Although the invention has been described in detail with reference to certain preferred embodiments, those skilled in the art will recognize that there are other embodiments of the invention within the spirit and the scope of the claims. For example, a Gifford-McMahon cryocooler or a Stirling cryocooler may be used rather than the pulse tube cryocooler illustrated in FIGS. 1 and 3. In addition many other frequency modulating mechanical resonators may be used. Among such other frequency modulating mechanical resonators one can name a resonator having the piston mass sealed to the wall by o-ring seals, a resonator having the piston mass sealed to the wall by a spring system, a resonator which uses a bellows arrangement holding, sealing and guiding the piston mass while providing additional spring constant to the resonator, and a resonator having such a bellows arrangement but wherein the piston mass is sealed to the wall using o-ring seals.

What is claimed is:

1. A frequency modulated cryocooler system comprising:

(A) an electrically driven pressure wave generator;

B) a frequency modulating mechanical resonator for receiving oscillating gas from the pressure wave generator; and (C) a cryocooler for receiving oscillating gas from the frequency modulating mechanical resonator.

2. The frequency modulated cryocooler system of claim 1 wherein the pressure wave generator is a linear compressor.

3. The frequency modulated cryocooler system of claim 1 wherein the frequency modulating mechanical resonator comprises a piston, mass and a spring member.

4. The frequency modulated cryocooler system of claim 1 comprising a second frequency modulating mechanical resonator wherein the two resonators are positioned in an opposed manner.

5. The frequency modulated cryocooler system of claim 1 wherein the cryocooler is a pulse tube cryocooler.

6. A method for operating a cryocooler system comprising:

(A) generating an oscillating gas oscillating at a frequency within the range of from 25 to 120 hertz using an electrically driven pressure wave generator;

(B) reducing the frequency of the oscillating gas using a frequency modulating mechanical resonator to produce lower frequency oscillating gas; and (C) passing the lower frequency oscillating gas to a cryocooler for the generation of refrigeration.

7. The method of claim 6 wherein the lower frequency oscillating gas has a frequency which is lower than the resonant frequency of the pressure wave generator.

8. The method of claim 6 wherein lower frequency oscillating gas has a frequency less than 30 hertz.

9. The method of claim 6 wherein the lower frequency oscillating gas has a frequency less than 10 hertz.

* * * * *